United States Patent [19]

Jilken

[11] Patent Number: 4,679,371

[45] Date of Patent: Jul. 14, 1987

[54] PROFILE

[75] Inventor: Ann-Christin Jilken, Sundsvall, Sweden

[73] Assignee: Adenco Engineering AB, Lidingo, Sweden

[21] Appl. No.: 589,080

[22] PCT Filed: Jun. 1, 1983

[86] PCT No.: PCT/SE83/00217

§ 371 Date: Feb. 2, 1984

§ 102(e) Date: Feb. 2, 1984

[87] PCT Pub. No.: WO83/04294

PCT Pub. Date: Dec. 8, 1983

[30] Foreign Application Priority Data

Jun. 4, 1982 [SE] Sweden ..... 8203465

[51] Int. Cl.[4] ..... E04C 1/04

[52] U.S. Cl. ..... 52/574; 52/588; 52/731

[58] Field of Search ..... 52/731, 284, 282, 574, 52/732, 730, 588

[56] References Cited

U.S. PATENT DOCUMENTS 745,570 12/1903 Clarke ..... 52/731
936,232 10/1909 Berg ..... 52/579
2,142,110 1/1939 Calkins et al. ..... 52/579
3,234,700 2/1966 Creveling ..... 52/284
3,435,575 4/1969 Pottiez ..... 52/282
4,192,119 3/1980 Murphy ..... 52/731 X

FOREIGN PATENT DOCUMENTS 1913623 9/1970 Fed. Rep. of Germany .
1476324 6/1977 United Kingdom .

*Primary Examiner*—Alfred C. Perham
*Assistant Examiner*—Jean M. Lakemper
*Attorney, Agent, or Firm*—Hayes, Davis & Soloway

[57] ABSTRACT

A profile consisting of two sections (1, 2) joined together. One section (1) is an open hollow section with an inner contour which is uniform with and somewhat bigger than the outer contour of the other section (2) and where the opening (4) is arranged so that two identical profiles can be telescoped into each other. According to the invention the other section (2) is solid or a closed hollow section. The opening (4) of the open hollow section (1), has a width which is somewhat bigger than the wall thickness of the hollow section (1) in an area (5), which is situated on the opposite side relative to the opening (4) of the connection (3) between the sections (1, 2). Thus, it is achieved that the open hollow sections (1) of the profiles substantially, completely surround the other sections (2) of the profiles, respectively, when two identical profiles are telescoped into each other.

4 Claims, 7 Drawing Figures

PROFILE

This invention relates to a profile consisting of two sections that are joined together out of which one is an open hollow section with an inner contour which is uniform with and somewhat bigger than the outer contour of the other section and where the opening is arranged so that two identical profiles can be telescoped into each other.

A similar profile has previously been known by GB-A No. 1,476,324, but there, both sections are open and furthermore the opening of each hollow section is so big that the respective sections are only partly surrounded. This naturally has an injurious effect on the torsional rigidity both concerning one profile and two profiles telescoped into each other.

The object of the present invention is to achieve a profile of the type explained by way of introduction which is not impaired with above said disadvantages and this is made possible in that the other section, is solid or a closed hollow one, and that the opening of the open hollow section, has a width which is somewhat bigger than the wall thickness of the hollow section in an area, which is situated on the opposite side relative to the opening of the connection between the sections, so that the hollow sections of the profiles substantially completely surround the other sections of the profiles, respectively, when two identical profiles are telescoped into each other.

According to a special characteristic of the invention the hollow section of two profiles can be united in a way that gives them a common wall and a profile which can be used in many ways. Thus, if the sections are orientated so that an imaginary line which divides the sections of one profile in half coincides with an equally imaginary line of the other section, the result is a straight profile which can be combined with identical profiles to build up the partition of a house or to cover the facade which will be explained further as follows. If the sections are orientated so that an imaginary line which divides the sections of one profile forms an angle with an equally imaginary line of the other profile, an angle-shaped profile is achieved, which can be used together with the straight profile to obtain a corner etc.

The said other section may either be solid or a hollow section, depending on the application for which the profile is intended.

For applications where the profile according to the invention is supposed to rotate, it is preferable for the sections to be semi-circular and joined so that the profile has a circular cross-section. Two profiles telescoped into each other result in a perfectly rounded axle and in case the said other section is a hollow section it is an advantage according to a specific characteristic to arrange at least one radial wall in the hollow section.

Figure 1:
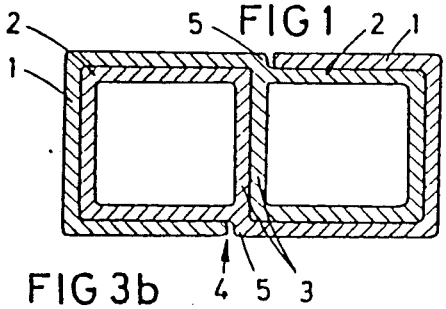

The invention will, in the following, be explained further with reference to the enclosed drawings, in which FIG. 1 shows a cross-section of an arrangement according to the invention with two profiles telescoped into each other. Each of the profiles consists of two rectangular hollow sections joined together.

Figure 2A:
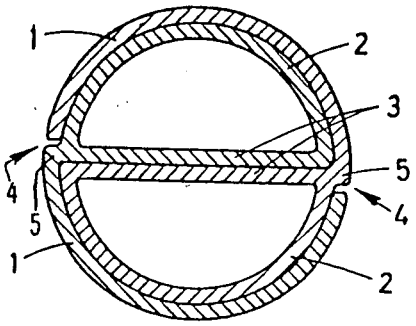

FIG. 2*a* shows a cross-section of profiles of another design telescoped into each other. This profile has a cross-section which from a general view, is circular.

Figure 2B:
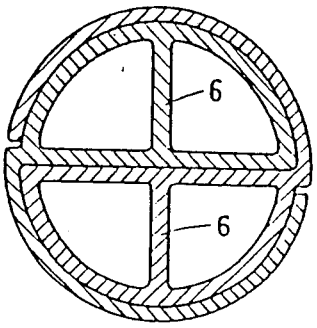

FIG. 2*b* shows a profile according to FIG. 2*a* where one hollow section is fitted with a radial wall.

Figure 3A:
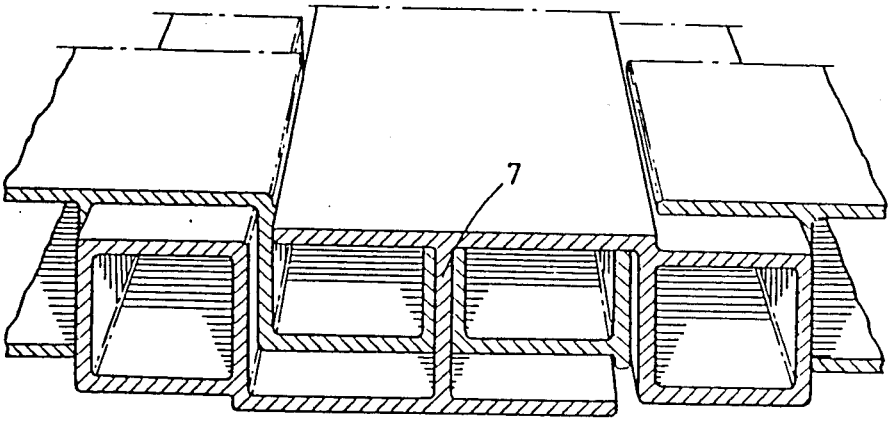
Figure 3B:
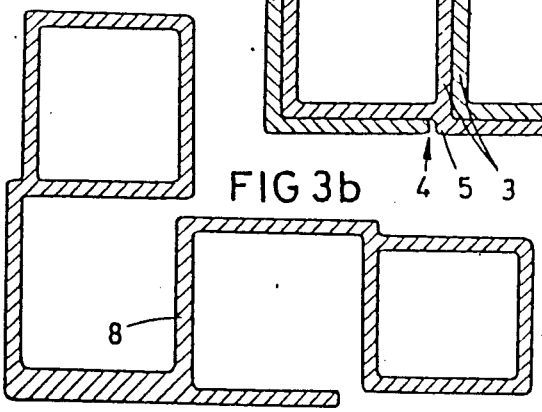
Figure 3C:
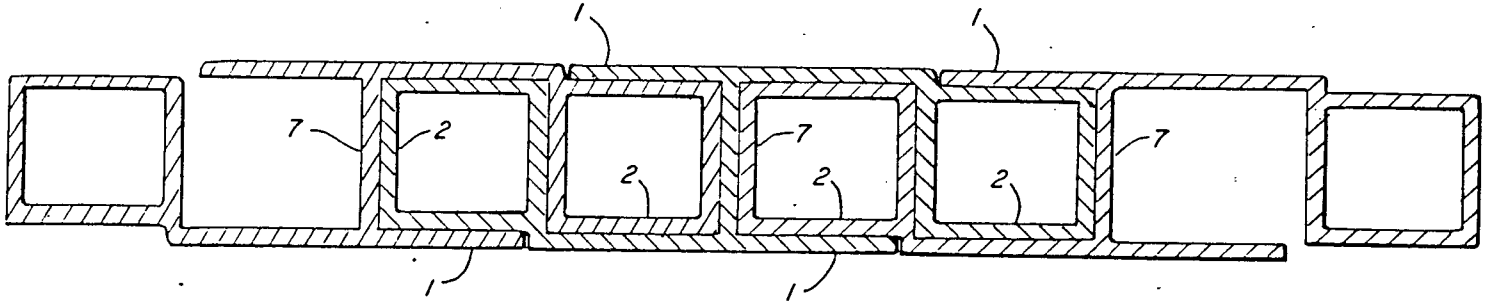

FIGS. 3*a*, 3*b* and 3*c* show a straight, an angle, and a straight profile, respectively, which has been achieved by combining two profiles according to FIG. 1.

Figure 4:
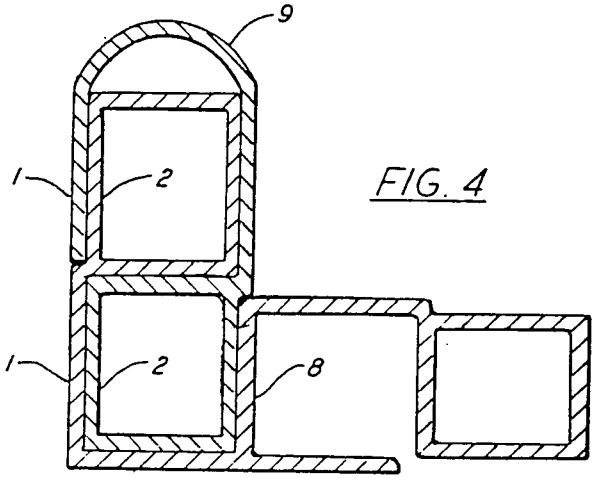

FIG. 4 shows a concluding profile which is combined with the profiles according to FIG. 3*b* and can be combined with the profile according to FIG. 3*a*.

FIG. 3*c* is a cross-section derived from FIG. 3*a* of such arrangement showing three profiles telescoped into each other.

A profile according to the invention consists of two sections 1, 2 joined together by means of a common wall 3.

Of the sections, section 1 is a hollow section with an inner contour which is uniform with and somewhat bigger than the outer contour of section 2. Depending on the field of application this can also be a hollow section filled with an insulation material or be solid and of the same material as the rest of the profile. Section 1 has an opening 4 which runs along the full length of the profile like a slot. The opening 4 is situated on one side of section 1 close to where it is connected to section 2 and has a width which is at least as big as the wall thickness of section 1 in an area 5 which is situated on the opposite side relative to the opening of the connection between the sections 1, 2 i.e. the wall 3.

An advantage with such a profile is that it can be telescoped into an identical profile and that section 1 of the profiles will respectively be surrounding section 2 of the other profile.

It can be noted that two profiles telescoped into each other in such a fashion together form a proportionately rigid hollow profile with an approximately smooth outer contour. Such a profile can easily be lengthened to an arbitrary length, without loss of rigidity, as the joints of the profiles respectively will be off set, and thus the profiles can be suitably used instead of boarding when building scaffolding. Another field of usage is swimming and boat bridges, where the cavities of the profile should be sealed or filled with a floating material, which will make the profiles unsinkable and due to that most suitable for this field of usage.

What has been described above relating to the profile according to FIG. 1, is mainly applicable on the profiles according to FIGS. 2*a* and 2*b*, apart from the fact that these profiles from a general point of view have circular cross-sections i.e. section 1, 2 are semicircular. Two profiles telescoped into each other can be used as an axle for transmitting a torsional movement. To increase the torsional rigidity and decrease the risk of natural oscillation of such an axle, one or more radial walls 6 can be arranged as shown in FIG. 2*b*.

The profile according to FIGS. 3*a* and 3*b* has been achieved by joining two profiles according to FIG. 1 by means of a common wall 7 and 8 respectively. The profile according to FIG. 3*a* is a straight, and from a general point of view, rectangular profile which can be put together in the same way as the profile according to FIG. 1, but the difference is that an arbitrary number of profiles can be put together. FIG. 3*c* is a cross-section derived from FIG. 3*a* of such arrangement showing three profiles telescoped into each other. In this way whole walls, floor or front faces can be achieved. When suitable at such applications, the cavities of the profiles can be filled with a heat insulating material. Corners are achieved with the profile according to FIG. 3*b* and a wall or something similar is preferably concluded by a profile according to FIG. 4. The walls of the hollow section 1 of this profile have a semi-circular part 9. This part can also be V-shaped or have any other suitable or attractive shape.

It is obvious that this invention cannot be considered to be restricted to the above described and the designs shown, but can be designed in many ways within the scope of the invention. The cross-section of the sections of a profile according to the invention, can from a general point of view be oval-shaped or elliptically egg-shaped.

I claim:

1. A combination including a first and a second profile, wherein each said profile consists of first and second sections (1, 2) rigidly joined together, each first section (1) being an open walled hollow section with an inner contour and each second section (2) being a closed hollow section with an outer contour, the inner contour being uniform with and somewhat bigger than the outer contour wherein each first section has an opening (4) arranged so that said first and second profiles can be telescoped into one another, each opening (4) having a width which is substantially no wider than the thickness the wall of the open walled hollow section (1) disposed in that opening (4) when the profiles are so telescoped, whereby the first section of the first of the telescoped profiles substantially, completely surrounds and rigidly interlocks with the second section (2) of the second of the telescoped profiles without recourse to additional members.

2. A profile according to claim 1, characterized in that the first sections (1) of two separate profiles are joined together by a wall (7, 8) common to both first sections to form a unitary section.

3. A combination including a first and a second profile, the first and second profiles, when telescoped together, forming a substantially rigid interlocking assembly; wherein the first and second profiles each comprise a first section, having an inner wall contour, and a second section, having an outer wall contour, which are connected together and have a surface common to both wall contours, the inner wall contour being similar to and not substantially larger than the outer wall contour, said first and second sections defining an opening therebetween, such that the inner and outer wall contours defining said opening are substantially co-planar, wherein the opening of the first profile is wide enough to receive a wall portion of the first section of the second profile, whereby the first section of the first profile encompasses and captively and rigidly engages the second section of the second profile to provide said rigid interlocking assembly.

4. A profile in accordance with claim 3, wherein said opening has a width which is not substantially greater than the wall thickness of said wall portion of said second section.

* * * * *